US010401749B2

(12) United States Patent
Kuwabara

(10) Patent No.: US 10,401,749 B2
(45) Date of Patent: Sep. 3, 2019

(54) TONER, DEVELOPING AGENT CONTAINER, IMAGE FORMING UNIT, AND IMAGE FORMING APPARATUS

(71) Applicant: Oki Data Corporation, Tokyo (JP)

(72) Inventor: Hideharu Kuwabara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/975,214

(22) Filed: May 9, 2018

(65) Prior Publication Data

US 2018/0348657 A1 Dec. 6, 2018

(30) Foreign Application Priority Data

May 30, 2017 (JP) ..... 2017-106460

(51) Int. Cl.

| | |
|---|---|
| ***G03G 9/08*** | (2006.01) |
| ***G03G 9/09*** | (2006.01) |
| ***G03G 9/097*** | (2006.01) |
| *G03G 9/087* | (2006.01) |

(52) U.S. Cl.

CPC ..... *G03G 9/0926* (2013.01); *G03G 9/0821* (2013.01); *G03G 9/0902* (2013.01); *G03G 9/09708* (2013.01); *G03G 9/08755* (2013.01)

(58) Field of Classification Search

CPC . G03G 9/0902; G03G 9/0926; G03G 9/09708
USPC ..... 430/111.4, 110.1
See application file for complete search history.

(56) References Cited

U.S. PATENT DOCUMENTS

2005/0026065 A1* 2/2005 Onuma ..... G03G 9/0817 430/110.3

FOREIGN PATENT DOCUMENTS

JP 2016186519 A 10/2016

* cited by examiner

*Primary Examiner* — Mark A Chapman
(74) *Attorney, Agent, or Firm* — Panitch Schwarze Belisario & Nadel LLP

(57) ABSTRACT

Provided are a toner, and a developing agent container, an image forming unit and an image forming apparatus including the toner. The toner includes a toner particle. The toner particle includes at least one brilliant pigment particle, binder resin containing the brilliant pigment particle, and a parting agent dispersed in the binder resin, wherein a hydrophobicity degree of the brilliant pigment particle is in a range from 61.2 to 92.7.

14 Claims, 4 Drawing Sheets

FIG. 3

| TEST OBJECT | TEST OBJECT TONER | TEST OBJECT BRILLIANT PIGMENT | MEASURED/ CALCULATED VALUE | | JUDGMENT ○: FINE ×: INFERIOR | | |
|---|---|---|---|---|---|---|---|
| | | | AVG. MAX. LENGTH [μ m] | HYDRO-PHOBICITY DEGREE HD [%] | BRILLIA-NTNESS FI | FOGG-ING -Δ Y | OVER -ALL |
| EXAMPLE E1 | TONER TA | BRILLIANT PIGMENT PA | 5 | 78.7 | ○ | ○ | ○ |
| EXAMPLE E2 | TONER TB | BRILLIANT PIGMENT PB | 5 | **61.2** | ○ | ○ | ○ |
| EXAMPLE E3 | TONER TC | BRILLIANT PIGMENT PC | 5 | **92.7** | ○ | ○ | ○ |
| EXAMPLE E4 | TONER TD | BRILLIANT PIGMENT PD | 20 | 91.4 | ○ | ○ | ○ |
| EXAMPLE E5 | TONER TE | BRILLIANT PIGMENT PE | 15 | 64.4 | ○ | ○ | ○ |
| COMP. EXAMPLE C1 | TONER TF | BRILLIANT PIGMENT PF | 5 | 47.2 | ○ | × | × |
| COMP. EXAMPLE C2 | TONER TG | BRILLIANT PIGMENT PG | 5 | 30.3 | × | × | × |
| COMP. EXAMPLE C3 | TONER TH | BRILLIANT PIGMENT PH | 3 | 83.6 | × | ○ | × |

FIG. 4A

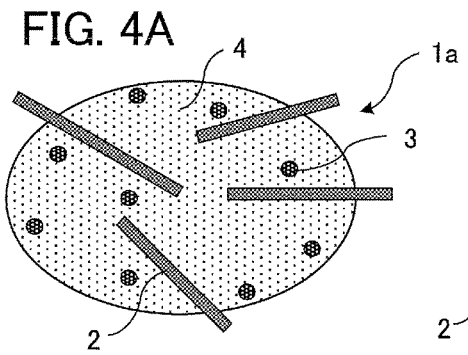

FIG. 4B

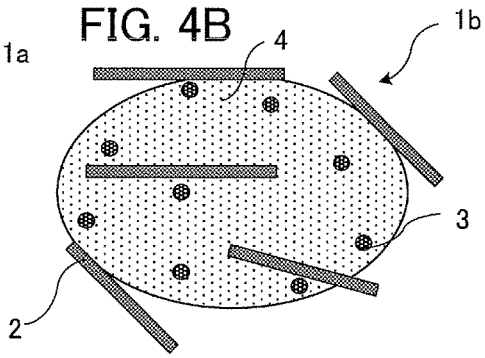

TONER, DEVELOPING AGENT CONTAINER, IMAGE FORMING UNIT, AND IMAGE FORMING APPARATUS

CROSS-REFERENCE TO RELATED APPLICATION

This application claims priority under 35 U.S.C. § 119(b) to Japanese Application No. 2017-106460, filed May 30, 2017, the disclosure of which is incorporated by reference herein in its entirety.

BACKGROUND OF THE INVENTION

1. Field of the Invention

The present invention relates to a toner containing a brilliant pigment and used for the development of electrostatic latent images in an image forming apparatus employing the electrophotographic method, and to a developing agent container, an image forming unit and an image forming apparatus including the toner.

2. Description of the Related Art

In recent years, with the prevalence and performance improvement of image forming apparatuses such as color printers for forming color images, brilliant toners used for forming an image having brilliantness like gold color or silver color on a record medium by employing the electrophotographic method (i.e., brilliant developing agents) are being developed. The brilliant toner contains a brilliant pigment (also referred to as "brilliant pigment particles") having brilliantness (see Japanese Patent Application Publication No. 2016-186519, for example).

However, since the brilliant pigment particle has an elongated plate-like shape and the dimension of the longest part (i.e., maximum length) of the brilliant pigment particle is 5 micrometers (μm) to 20 μm, it is difficult to make the whole of each brilliant pigment particle be contained in binder resin used as the main ingredient of the toner particle. Faulty charging tends to occur to the toner particle when a part of a brilliant pigment particle projects (i.e., is exposed) to the outside of the surficial layer of the binder resin surrounding the brilliant pigment particle. Therefore, when an image is formed on a record medium by an image forming apparatus including a toner made of such toner particles, fogging (i.e., a stain in a background part of the image) tends to occur.

SUMMARY OF TIE INVENTION

The object of the present invention, which has been made to resolve the above-described problem, is to provide a toner capable of giving high brilliantness to an image formed on a record medium while inhibiting the occurrence of the fogging, and to provide a developing agent container, an image forming unit and an image forming apparatus including the toner.

A toner according to an aspect of the present invention includes a toner particle. The toner particle includes at least one brilliant pigment particle, binder resin containing the brilliant pigment particle, and a parting agent dispersed in the binder resin. A hydrophobicity degree of the brilliant pigment particle is in a range from 61.2 to 92.7.

A developing agent container according to another aspect of the present invention includes the above-mentioned toner and a container part that stores the toner.

An image forming unit according to still another aspect of the present invention includes the above-mentioned toner and a development device that stores the toner and supplies the toner to an image bearing body on which an electrostatic latent image is formed.

An image forming apparatus according to yet another aspect of the present invention includes the above-mentioned image forming unit, an image transfer section that transfers a toner image formed on the image bearing body in the image forming unit onto a record medium, and a fixation section that fixes the transferred toner image.

With the toner according to the present invention, an effect can be obtained in that high brilliantness can be given to an image formed on a record medium while inhibiting the occurrence of the fogging.

With the developing agent container, the image forming unit and the image forming apparatus according to the present invention, an effect can be obtained in that an image printed with the toner containing the brilliant pigment particles has high brilliantness and the occurrence of the fogging can be inhibited.

BRIEF DESCRIPTION OF TEE DRAWINGS

In the attached drawings,

FIG. 3 is a diagram showing results of an evaluation test in regard to examples and comparative examples in a tabular format;

FIGS. 4A and 4B are schematic diagrams showing cross-sectional structure of brilliant toner particles contained in an inferior toner;

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

In the following, a description will be given of a brilliant (or glistening) toner as a toner (developing agent) according to an embodiment of the present invention, a developing agent cartridge as a developing agent container including the brilliant toner, an image forming unit including the brilliant toner, and an image forming apparatus including the image forming unit. The toner, the developing agent container, the image forming unit and the image forming apparatus described below are just an example and various modifications are possible within the scope of the present invention.

In the present embodiment, a new range of a hydrophobicity degree of a brilliant toner desirable as a brilliant toner giving high brilliantness to an image and hardly causing the fogging is determined by focusing on the fact that the brilliantness and the fogging of an image are closely related to the hydrophobicity degree of the brilliant toner used for the image formation.

Further, in the present embodiment, a new range of the average maximum length of brilliant toner particles desirable as the brilliant toner giving high brilliantness to an image and hardly causing the fogging is determined by focusing on the fact that the brilliantness and the fogging of an image are closely related to the average maximum length of the brilliant toner particles.

<1> Brilliant Toner

<1-1> Configuration

Figure 1:
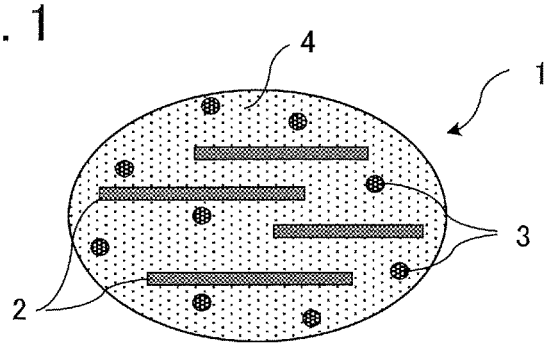
FIG. 1 is a schematic diagram showing cross-sectional structure of a toner particle of a brilliant toner according to an embodiment of the present invention.

FIG. 1 is a schematic diagram showing cross-sectional structure of a toner particle (referred to also as a "brilliant toner particle") 1 of a brilliant toner according to the present embodiment. As shown in FIG. 1, the brilliant toner particle 1 according to the present embodiment includes a pigment particle (referred to also as a "brilliant pigment particle") 2 of a brilliant pigment as an internal additive, binder resin 4 containing at least one (generally, more than one) brilliant pigment particle 2 as the internal additive, and a parting agent (i.e., release agent) 3 dispersed in the binder resin 4. In the present embodiment, the brilliant toner particle 1 is formed of brilliant pigment particles 2 having a hydrophobicity degree in a range from 61.2 to 92.7. More desirably, in the present embodiment, the brilliant toner particle 1 is formed of brilliant pigment particles 2 having a hydrophobicity degree in a range from 61.2 to 92.7 and does not include a brilliant pigment particle 2 having a hydrophobicity degree outside the range from 61.2 to 92.7.

An example of the brilliant pigment particle 2 is a metallic material flake in a plate-like shape (including an aluminum flake). An example of the parting agent is paraffin wax. An example of the binder resin is polyester. It is possible to use other publicly known materials as the brilliant pigment or the parting agent. As the other publicly known materials, materials described in Japanese Patent Application Publication No. 2016-65965 are usable, for example.

The average maximum length of the brilliant pigment particles 2 contained in the brilliant toner according to the present embodiment is desired to be in a range from 5 μm to 20 μm. The "average maximum length" is obtained by measuring the maximum length in each brilliant pigment particle 2 and calculating the average value of the maximum lengths of the brilliant pigment particles 2.

As shown in FIG. 1, the brilliant pigment particles 2 in the brilliant toner particle 1 are oriented substantially in a uniform direction. Accordingly, a plurality of brilliant pigment particles 2 can efficiently reflect light on the record medium and high brilliantness can be exhibited. Incidentally, in the present embodiment, whether the brilliant pigment particles 2 are oriented substantially in a uniform direction or not is judged based on whether or not a flop index (FI) value which will be explained later is larger than or equal to a predetermined FI threshold value (e.g., 14). Namely, if the FI value is larger than or equal to the FI threshold value, it is found that a sufficient number of brilliant pigment particles 2 have light-reflecting surfaces substantially parallel to each other.

Further, since the brilliant pigment particles 2 can be contained in the binder resin 4 in the brilliant toner particle 1, that is, since the brilliant pigment particle 2 can be configured not to have a part projecting to the outside of the surficial layer of the binder resin 4 (i.e., exposed part), the faulty charging of the brilliant toner particles 1 can be prevented and the occurrence of the fogging as a stain in the background part of the image can be inhibited.

In the present embodiment, a judgment on this property is made based on whether or not a fog value (−ΔY), as a change amount of luminance which will be explained later, is less than a predetermined threshold value (e.g., 1.5) of the fog change amount. Namely, if the fog change amount (−ΔY) is less than the predetermined threshold value, it means that substantially no faulty charging has occurred to the brilliant toner particles, and accordingly, it can be found that most of the brilliant pigment particles 2 are formed not to have a part projecting to the outside of the surficial layer of the binder resin 4.

<1-2> Evaluation Test

An evaluation test for determining conditions that should be satisfied by a brilliant toner capable of giving high brilliantness to the image formed on a record medium while inhibiting the occurrence of the fogging will be described below. Eight types of brilliant toners were used for the evaluation test. According to the result of the evaluation test, the eight types of brilliant toners are classified into brilliant toners of examples E1 to E5 belonging to the present embodiment and brilliant toners of comparative examples C1 to C3 not belonging to the present embodiment.

Example E1

A toner generation process according to the example E1 includes the following first to fourth steps:

(First Step) Step for Obtaining Aqueous Medium Containing Inorganic Dispersant Dispersed Therein 738 pts·wt. (i.e., parts by weight) of industrial trisodium phosphate 12-hydrate is mixed into 21200 pts·wt. of pure water, dissolved at a solution temperature of 60° C., and thereafter dilute nitric acid for pH control is added to the solution.

Subsequently, into this solution, a calcium chloride aqueous solution obtained by dissolving 356 pts·wt. of industrial calcium chloride anhydrous in 3617 pts·wt. of pure water is mixed, and an aqueous phase containing a suspension stabilization agent (inorganic dispersant) (i.e., aqueous medium containing the inorganic dispersant dispersed therein) is obtained by performing high-speed stirring at 3566 revolutions per minute (rpm) for 34 minutes while maintaining the solution temperature at 60° C. by using Line Mill (produced by Primix Corporation) as a mixing apparatus.

(Second Step) Step for Obtaining Pigment Dispersion Oil Medium

On the other hand, a pigment dispersion liquid is diluted with 7546 pts·wt. of ethyl acetate and this solution is mixed with 252 pts·wt. of brilliant pigment PA (average maximum length of brilliant pigment particles: 5 μm, a hydrophobicity degree: 78.7) and 38 pts·wt. of a charging control agent "electric charge control agent BONTRON E-84" (produced by Orient Chemical Industries Co., Ltd.).

Thereafter, the liquid obtained by the mixing is heated up to a solution temperature of 60° C. and stirred.

Thereafter, into this liquid, 38 pts·wt. of "toner resin-based electric charge control agent FCA-726N" (produced by Fujikura Kasei Co., Ltd.) as charging control resin, 95 pts·wt. of ester wax "WE-4" (produced by NOF Corporation), and 838 pts·wt. of polyester resin are mixed, the mixture is stirred until solid materials disappear, and thereby an oil phase (pigment dispersion oil medium) is obtained.

(Third Step) Step for Generating Toner Base Particles

Into the aqueous phase obtained in the first step and maintained at the solution temperature of 60° C., the oil phase obtained in the second step is mixed and thereafter the liquid is stirred at 1000 rpm for 5 minutes, by which a suspension is obtained and base particles are formed.

Thereafter, ethyl acetate is removed by means of reduced-pressure distillation, by which slurry containing the base particles is obtained.

Thereafter, nitric acid is added to the slurry containing the base particles to lower the pH to 1.6 or less, and the mixture is stirred, by which tricalcium phosphate as the suspension stabilization agent is dissolved while also causing dehydration.

Thereafter, the dehydrated base particles are redispersed in pure water and stirred, by which the base particles are rinsed with water. Thereafter, toner base particles are generated by dehydrating, drying and classifying the water-rinsed base particles.

(Fourth Step) External Additive Step

Subsequently, into the toner base particles generated in the third step, 0.7 wt % of small silica "RY200" (produced by Nippon Aerosil Corporation) and 1.0 wt % of colloidal silica "silica spherical fine particles X24-9163A" (produced by Shin-Etsu Chemical Co., Ltd.) as external additives are poured and mixed, by which a "toner TA" according to the example E1 is obtained.

Example E2

A toner generation process according to the example E2 is a process for generating a "toner TB" by using brilliant pigment PB (average maximum length of brilliant pigment particles: 5 μm, a hydrophobicity degree: 61.2) instead of the brilliant pigment PA in the example E1 and setting the other conditions as in the toner generation process in the example E1.

Example E3

A toner generation process according to the example E3 is a process for generating a "toner TC" by using brilliant pigment PC (average maximum length of brilliant pigment particles: 5 μm, a hydrophobicity degree: 92.7) instead of the brilliant pigment PA in the example E1 and setting the other conditions as in the toner generation process in the example E1.

Example E4

A toner generation process according to the example E4 is a process for generating a "toner TD" by using brilliant pigment PD (average maximum length of brilliant pigment particles: 20 μm, a hydrophobicity degree: 91.4) instead of the brilliant pigment PA in the example E1 and setting the other conditions as in the toner generation process in the example E1.

Example E5

A toner generation process according to the example E5 is a process for generating a "toner TE" by using brilliant pigment PE (average maximum length of brilliant pigment particles: 15 μm, a hydrophobicity degree: 64.4) instead of the brilliant pigment PA in the example E1 and setting the other conditions as in the toner generation process in the example E1.

Comparative Example C1

A toner generation process according to the comparative example C1 is a process for generating a "toner TF" by using brilliant pigment PF (average maximum length of brilliant pigment particles: 5 μm, a hydrophobicity degree: 47.2) instead of the brilliant pigment PA in the example E1 and setting the other conditions as in the toner generation process in the example E1.

Comparative Example C2

A toner generation process according to the comparative example C2 is a process for generating a "toner TG" by using brilliant pigment PG (average maximum length of brilliant pigment particles: 5 μm, a hydrophobicity degree: 30.3) instead of the brilliant pigment PA in the example E1 and setting the other conditions as in the toner generation process in the example E1.

Comparative Example C3

A toner generation process according to the comparative example C3 is a process for generating a "toner TH" by using brilliant pigment PH (average maximum length of brilliant pigment particles: 3 μm, a hydrophobicity degree: 83.6) instead of the brilliant pigment PA in the example E1 and setting the other conditions as in the toner generation process in the example E1.

<Calculation of Hydrophobicity Degree>

The hydrophobicity degree of each of the brilliant pigments (PA-PE) in the examples E1-E5 and the brilliant pigments (PF-PH) in the comparative examples C1-C3 was obtained according to the following procedure:

First, 2 grams (g) of the toner (TA-TH) is dissolved in 100 milliliters (ml) of THF (tetrahydrofuran), and the solution is filtered by using filter paper "quantitative filter paper No. 5A" (produced by ADVANTEC corporation).

Solid matter obtained by the filtering is dissolved again in 100 ml of THF, solid matter is obtained by conducting the filtering by using filter paper, and the solid matter is dried to remove THF.

By such a process, each of the brilliant pigments (PA-PE) in the examples E1-E5 and the brilliant pigments (PF-PH) in the comparative examples C1-C3 is collected as the solid matter.

A resin component contained in the toner is dissolved in THF and removed, while the external additives and the charging control agent have small particle diameters and pass through the filter paper, and thus the solid matter remaining on the filter paper contains almost exclusively the brilliant pigment as one of the brilliant pigments (PA-PE) in the examples E1-E5 and the brilliant pigments (PF-PH) in the comparative examples C1-C3. Even when a substance other than the brilliant pigment remains in the brilliant pigment as one of the brilliant pigments (PA-PE) in the examples E1-E5 and the brilliant pigments (PF-PH) in the comparative examples C1-C3 collected by the filtering, the amount of the remaining substance is negligibly small.

30 g of methanol is poured into 0.1 g of the solid matter collected by the filtering, the solution is stirred, pure water is gradually added to the solution, and the addition of pure water is stopped at a point when solid matter precipitates at the surface of the solution. The criterion for the judgment on the precipitation is that the size of the solid matter (precipitation) has reached 5 mm cubic or larger.

The hydrophobicity degree HD [%] is calculated by using the following expression 1:

$$HD = \frac{\text{(Methanol weight after evaluation)}}{\text{(Methanol weight after evaluation)} + \text{(Weight of added pure water)}} \times 100 \quad \text{expression 1}$$

The "weight of added pure water" in the expression 1 represents the weight of pure water added the brilliant pigment particles from the start of the addition of pure water to the stoppage of the addition. The "methanol weight after evaluation" in the expression 1 represents the methanol weight at the point when solid matter precipitates at the surface of the solution (i.e., the point when the addition of pure water is stopped). The "methanol weight after evaluation" is weight that is lighter by the weight of evaporated methanol than the methanol weight 30 g at the point when the solid matter was dissolved in methanol.

<Measurement of Average Maximum Length of Brilliant Pigment Particles>

Each of the above-described toners (TA-TH) as brilliant toners was dispersed in a surfactant "Emulgen 109P" (produced by Kao Corporation), the solution was dropped on a glass slide, a cover glass was put on the solution on the glass slide, and the solution was observed by using a microscope at 1000× magnification with transmissive illumination.

A "digital microscope VH-5500" (produced by Keyence Corporation) was used as the microscope, and a lens "VH-500" (produced by Keyence Corporation) was attached to the microscope. The maximum length of each brilliant pigment particle contained in the brilliant toner was measured in regard to a predetermined number of brilliant pigment particles per brilliant toner particle by taking advantage of the fact that each brilliant pigment particle blocks light (and thus looks black). The average maximum length of brilliant pigment particles in each toner (TA-TH) was obtained by calculating the average value (i.e., average maximum length) of the predetermined number of measurements (maximum lengths) obtained. The predetermined number is a number previously determined as a number larger than or equal to 1. The predetermined number is 50, for example.

<Judgment on Brilliantness>

Printing on a record medium (print sheet) was performed by a printer using one of the aforementioned toners (TA-TH) as a brilliant toner as a specific toner, and the brilliantness of the developing agent after fixation was measured. A "color LED printer C941" (produced by Oki Data Corporation) was used as the printer and the brilliantness of a solid image part on the record medium was determined by using a goniophotometer "GC-5000L" (produced by Nippon Denshoku Industries Co., Ltd.).

Figure 2:
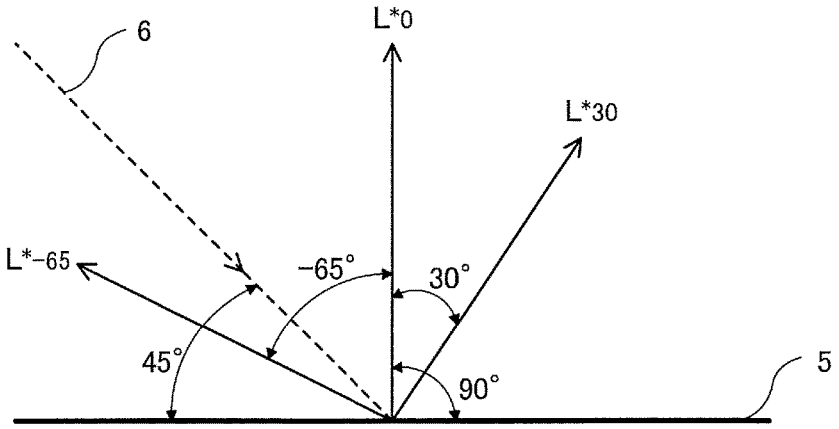
FIG. 2 is a diagram for explaining a method for calculating a flop index (FI) value representing brilliantness of a solid image.

The brilliantness is represented by a flop index (FI) value that is calculated according to the following expression 2 (FIG. 2):

$$FI = 2.69 \times \frac{(L^*_{30} - L^*_{-65})^{1.11}}{(L^*_0)^{0.86}} \quad \text{expression 2}$$

The brilliantness of the image is higher with the increase in the FI value and is lower with the decrease in the FI value. The brilliantness was judged to be fine (circle mark) when the FI value was higher than or equal to 14 as the predetermined FI threshold value, or to be inferior (cross mark) when the FI value was less than 14 as the FI threshold value.

<Judgment on Fogging>

A judgment was made on the fogging on the printed matter caused by the printer using each toner (TA-TH) as the brilliant toner.

In the middle of blank paper printing by the "color LED printer C941" (produced by Oki Data Corporation) as the printer using the brilliant toner, the print operation is momentarily interrupted, the toner on the photosensitive body is made to adhere to mending tape "Scotch adhesive tape" (produced by 3M Company), the fog value ΔY on the mending tape stuck on a sheet "Excellent White" (produced by Oki Data Corporation) is measured with a spectrophotometric colorimeter "CM-2600d" (produced by Konica Minolta, Inc.), and the fogging is evaluated based on the measurement value.

Specifically, the fog value ΔY represents the amount of fogging toner adhering to the photosensitive body (i.e., the surface of the photosensitive drum), that is, the amount of toner adhering to a region that should originally be white. In the measurement of the fogging toner amount, the printer is stopped in the middle of the print process at the 0% print density, and after the development of the toner image (i.e., after the supply of the toner from the development device to the photosensitive body), the mending tape is once stuck on the photosensitive body before the image transfer (i.e., before the toner on the photosensitive body is transferred to the record medium) to collect the fogging toner. Thereafter, the mending tape is peeled off, the mending tape that collected the toner is stuck on a white sheet, and comparative tape as mending tape not stuck on the photosensitive body is stuck on a white sheet as the object of comparison. Then, the fog value $(-\Delta Y)=Y0-Y1$ $(Y1 \leq Y0)$ as a luminance change amount as the difference between the luminance Y1 of the fog collection tape and the luminance Y0 of the comparative tape is calculated.

The amount of the fogging toner on the surface of the photosensitive body is greater as the fog value $(-\Delta Y)$ is greater. Thus, in the present embodiment, a fogging threshold value is set at 1.5, the resulting judgment is fine (circle mark) when the fog value $(-\Delta Y)$ is less than the fogging threshold value 1.5, and the resulting judgment is inferior (cross mark) when the fog value $(-\Delta Y)$ is larger than or equal to 1.5.

<Overall Judgment>

The results of the above-described evaluation test in regard to the examples E1-E5 and the comparative examples C1-C3 are shown in FIG. 3 in a tabular format.

It can be seen in FIG. 3 that the overall judgment is fine (circle mark) in regard to the examples E1-E5 and inferior (cross mark) in regard to the comparative examples C1-C3.

Further, it can be seen in FIG. 3 that the fog value $(-\Delta Y)$ is fine when the hydrophobicity degree is in a range from 61.2 to 92.7, that is, in cases where the hydrophobicity degree is higher than or equal to 61.2 and lower than or equal to 92.7.

Furthermore, it can be seen in FIG. 3 that the brilliantness is inferior in cases where the average maximum length is less than 5 μm. This is because the brilliantness specific to brilliant pigments weakens due to a too small average maximum length of the brilliant pigment particles.

In contrast, in cases where the average maximum length of the brilliant pigment particles is larger than 20 μm, it becomes difficult for the brilliant pigment particles to be contained in the toner particles and the toner transfer in the electrophotographic process becomes difficult.

<1-3> Effects

As described above, toners whose brilliant pigment hydrophobicity degree is in the range from 61.2 to 92.7 enable printing with little fogging. Among toners containing brilliant pigment particles whose average maximum length is in the range from 5 μm to 20 μm, toners whose brilliant pigment hydrophobicity degree is in the range from 61.2 to 92.7 enable printing with high brilliantness and little fogging.

In cases where the hydrophobicity degree is less than 61.2, it becomes difficult for the brilliant pigment particles 2 to be contained in the binder resin 4 as shown in FIGS. 4A and 4B, part of the brilliant pigment particles 2 are exposed to the outside of the surface of the binder resin 4 of the toner particle, the faulty charging occurs, and the printing results in a lot of fogging.

Further, brilliant pigments having a hydrophobicity degree higher than 92.7 are difficult to produce. Even if a brilliant pigment having a hydrophobicity degree higher than 92.7 is produced successfully, the brilliant feel specific to brilliant pigment particles is impaired due to a great amount of hydrophobizing agent existing on the surfaces of the brilliant pigment particles.

<2> Image Forming Apparatus

Figure 5:
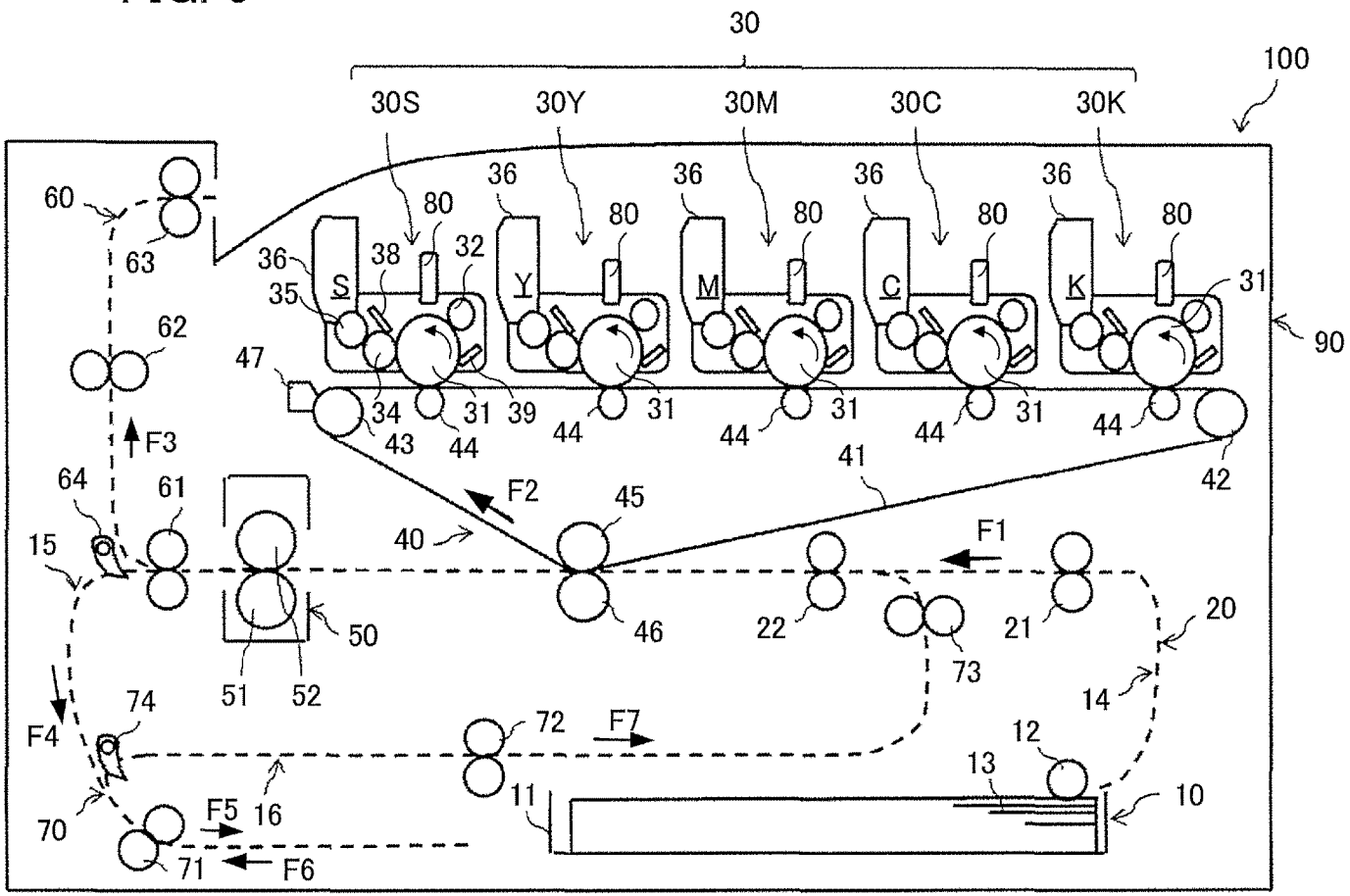
FIG. 5 is a schematic vertical cross-sectional view showing the configuration of an image forming apparatus according to the embodiment.

FIG. 5 is a schematic vertical cross-sectional view showing the configuration of an image forming apparatus 100 according to the embodiment of the present invention.

The image forming apparatus 100 is a printer that forms a color image on a record medium 13 such as a print sheet by employing the electrophotographic method. In a housing 90, the image forming apparatus 100 includes a sheet feed section 10 as a medium supply means, a conveyance section 20 as a medium conveyance means, an image forming section 30 including a development device, an image transfer section 40 as a toner image transfer means, a fixation section 50 as a toner image fixation means, an ejection section 60 as a medium ejection means, an inversion section 70 as a medium inversion means, and an LED head 80 as an exposure means.

The sheet feed section 10 includes a sheet feed tray (medium cassette) 11 on which a plurality of record media 13 are stacked up and a pickup roller 12 that sends out the record media 13 sheet by sheet.

The conveyance section 20 includes a conveyance roller pair 21 and a registration roller pair 22. The conveyance roller pair 21 conveys the record medium 13 along a conveyance path 14 in a conveyance direction F1 towards the image transfer section 40. The registration roller pair 22 corrects the skewing of the record medium 13.

The image forming section 30 includes five image forming units 30S, 30Y, 30M, 30C and 30K. Each image forming unit 30S, 30Y, 30M, 30C, 30K forms a toner image of its respective color by developing an electrostatic latent image formed on the surface of a photosensitive drum 31 of the image forming unit 30S, 30Y, 30M, 30C, 30K respectively with a brilliant toner S as the specific toner, a yellow toner Y, a magenta toner M, a cyan toner C and a black toner K. The brilliant toner S is formed of a plurality of brilliant toner particles 1 explained earlier with reference to FIG. 1 to FIG. 3.

Each image forming unit 30S, 30Y, 30M, 30C, 30K includes the photosensitive drum 31 as an image bearing body, a charging roller 32 as a charging means, a development roller 34, a supply roller 35, a developing agent cartridge 36, a regulatory blade 38, and a cleaning blade 39. Further, the LED head 80 is provided to face the surface of the photosensitive drum 31. It is also possible to provide a laser scanning optical system including a semiconductor laser and a laser beam scanning means instead of the LED head 80.

The charging roller 32 uniformly charges the surface (peripheral surface) of the photosensitive drum 31.

The LED head 80 forms an electrostatic latent image corresponding to image data by exposing the uniformly charged surface of the photosensitive drum 31 according to control by a control section. The LED head 80 includes a plurality of LEDs arranged in a width direction of the photosensitive drum 31 and a lens array in which a plurality of non-magnifying upright imaging lenses are arranged.

The development roller 34 supplies the toner to the surface of the photosensitive drum 31. The supply roller 35 supplies the toner to the development roller 34. The developing agent cartridge 36 includes a container part that stores the toner. The developing agent cartridges 36 in the image forming units 30S, 30Y, 30M, 30C and 30K respectively include the brilliant toner S, the yellow toner Y, the magenta toner M, the cyan toner C and the black toner K.

The regulatory blade 38 regulates the layer thickness of the toner borne on the surface of the development roller 34.

The image transfer section 40 includes an intermediate transfer belt 41, a drive roller 42 for driving the intermediate transfer belt 41, a tension roller 43 as a driven roller, a plurality of primary transfer rollers 44, a counter roller 45, a secondary transfer roller 46, and a cleaning member 47. The intermediate transfer belt 41 is stretched across the drive roller 42, the tension roller 43 and the counter roller 45 and supported by the rollers 42, 43 and 45 to be movable in a direction F2. The image transfer section 40 successively transfers the toner images formed in the image forming units 30S, 30Y, 30M, 30C and 30K to the surface of the intermediate transfer belt 41 (primary transfer) and thereafter electrostatically transfers the toner images on the intermediate transfer belt 41 onto the record medium 13 advancing in the conveyance direction F1 (secondary transfer). The record medium 13 on which the toner images have been stacked up is conveyed to the fixation section 50.

The cleaning member 47 scrapes off the toners remaining on the surface of the intermediate transfer belt 41

The fixation section 50 includes an upper roller (heat roller) 52 having a built-in heater and a lower roller 51, and fixes the toner images on the record medium 13 by heating and pressing the record medium 13 having the toner images stacked thereon.

The ejection section 60 includes conveyance roller pairs 61, 62 and 63 and a switching guide 64. The conveyance roller pairs 61, 62 and 63 convey the record medium 13 in a direction F3 along a conveyance path of the ejection section 60 and eject the record medium 13 onto a stacker outside the housing 90.

The inversion section 70 turns over the record medium 13 conveyed by the switching guide 64 to a conveyance path 15 and then sends out the inverted record medium 13 to an upstream side of the secondary transfer roller 46 in the conveyance direction. The inversion section 70 includes an inversion roller pair 71, conveyance roller pairs 72 and 73, and a switching guide 74. The inversion roller pair 71 first draws the record medium 13 into a part of the conveyance path 15 used for the inversion (i.e., in a direction F5), thereafter the switching guide 74 switches the conveyance path, and then the inversion roller pair 71 sends out the record medium 13 to an inversion conveyance path 16 (i.e., in a direction F6 and thereafter in a direction F7).

As described above, with the image forming apparatus 100 according to the present embodiment, printing with little fogging becomes possible with toners whose brilliant pigment hydrophobicity degree is in the range from 61.2 to 92.7. Among toners containing brilliant pigment particles whose average maximum length is in the range from 5 μm to 20 μm, toners whose brilliant pigment hydrophobicity degree is in the range from 61.2 to 92.7 enable printing with high brilliantness and little fogging.

<3> Image Forming Unit

Figure 6:
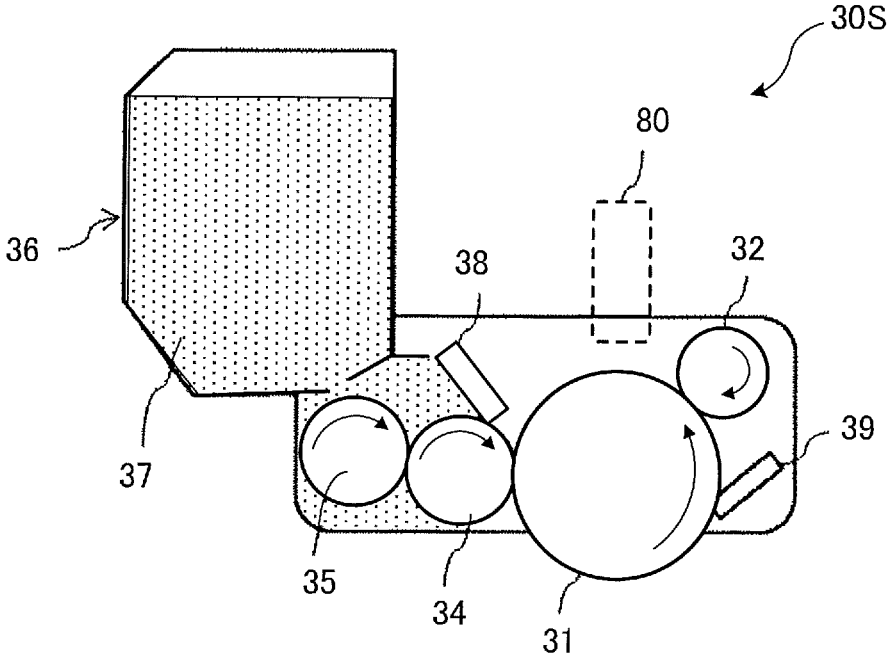
FIG. 6 is a schematic vertical cross-sectional view showing the structure of an image forming unit (including a developing agent cartridge) according to the embodiment.

FIG. 6 is a schematic vertical cross-sectional view magnifying the configuration of the image forming unit 30S shown in FIG. 5. The brilliant toner S included in the image forming unit 30S is formed of the brilliant toner particles 1 explained earlier with reference to FIG. 1 to FIG. 3.

In the image forming unit 30S, the photosensitive drum 31 rotates counterclockwise in FIG. 6 at a constant speed. The charging roller 32 rotates following the photosensitive drum 31 and uniformly charges the surface of the photosensitive drum 31. The LED head 80 exposes the surface of the photosensitive drum 31 according to image data and thereby forms an electrostatic latent image corresponding to the image data.

The supply roller 35 supplies the brilliant toner S, supplied from the developing agent cartridge 36 as the developing agent container, to the development roller 34. The developing agent cartridge 36 is configured to be freely attachable/detachable to/from the image forming unit 30S. On the surface of the development roller 34, a thin toner layer having a thickness regulated by the regulatory blade 38 is formed. The thin toner layer on the surface of the development roller 34 adheres to the electrostatic latent image on the surface of the photosensitive drum 31, by which the electrostatic latent image is developed into a toner image (developing agent image) of the brilliant toner S.

The toner image formed on the surface of the photosensitive drum 31 is transferred onto the intermediate transfer belt 41 due to a transfer voltage applied to the primary transfer roller 44.

Similarly, toner images of yellow, magenta, cyan and black are successively transferred onto the intermediate transfer belt 41 by the image forming units 30Y, 30M, 30C and 30K.

As described above, with the developing agent container 36 and the image forming unit 30S according to the present embodiment, printing with little fogging becomes possible with toners whose brilliant pigment hydrophobicity degree is in the range from 61.2 to 92.7. Among toners containing brilliant pigment particles whose average maximum length is in the range from 5 μm to 20 μm, toners whose brilliant pigment hydrophobicity degree is in the range from 61.2 to 92.7 enable printing with high brilliantness and little fogging.

<4> Modifications

While a case where the brilliant toner S is a toner containing brilliant pigment particles 2 has been described above, the present invention is not limited to this example. According to the results of the evaluation test shown in FIG. 3, the present invention is applicable also to toner particles each using at least one (generally, more than one) different internal additive particle instead of the brilliant pigment particles 2. Namely, toners according to the embodiment of the present invention can include a toner including at least one internal additive particle, binder resin 4 containing the internal additive particle, and a parting agent 3 dispersed in the binder resin 4 wherein the hydrophobicity degree of the internal additive particle is in the range from 61.2 to 92.7. In this case, the average maximum length of the at least one internal additive particle is not a nanometer (nm) size but a micrometer (μm) size and is in the range from 5 μm to 20 μm, for example. The internal additive particle can be a particle other than the brilliant pigment particle, such as a pigment particle of the yellow toner Y, a pigment particle of the magenta toner M, a pigment particle of the cyan toner C, or a pigment particle of the black toner K.

Further, the image forming apparatus 100 is not limited to printers but can be a different type of device such as a copier, a facsimile machine or an MFP (Multifunction Peripheral).

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. A toner comprising a toner particle, the toner particle including:

at least one brilliant pigment particle;

binder resin containing the brilliant pigment particle; and a parting agent dispersed in the binder resin, wherein a hydrophobicity degree of the brilliant pigment particle is in a range from 61.2 to 92.7.

2. The toner according to claim 1, wherein an average maximum length of the at least one brilliant pigment particle is in a range from 5 μm to 20 μm.

3. The toner according to claim 1, wherein the hydrophobicity degree HD is obtained by an expression $$HD = \frac{\text{(Methanol weight after evaluation)}}{\text{(Methanol weight after evaluation)} + \text{(Weight of added pure water)}} \times 100$$

where the weight of added pure water represents weight of the pure water added to the brilliant pigment particles from a start of addition of the pure water to a stoppage of the addition, and the methanol weight after evaluation represents methanol weight at a point when the brilliant pigment particles as solid matter precipitates at a surface of solution including the pure water and the methanol.

4. A developing agent container comprising:

the toner according to claim 1; and a container part that stores the toner.

5. An image forming unit comprising:

the toner according to claim 1; and a development device that stores the toner and supplies the toner to an image bearing body on which an electrostatic latent image is formed.

6. An image forming apparatus comprising:

the image forming unit according to claim 5;

an image transfer section that transfers a toner image formed on the image bearing body in the image forming unit onto a record medium; and a fixation section that fixes the transferred toner image.

7. The toner according to claim 1, wherein the binder resin contains the brilliant pigment particle as an internal additive particle.

8. A toner comprising a toner particle, the toner particle including:

at least one internal additive particle;

binder resin containing the internal additive particle; and a parting agent dispersed in the binder resin, wherein a hydrophobicity degree of the internal additive particle is in a range from 61.2 to 92.7.

9. The toner according to claim 8, wherein an average maximum length of the at least one internal additive particle is in a range from 5 μm to 20 μm.

10. The toner according to claim 8, wherein the internal additive particle is a pigment particle.

11. The toner according to claim 8, wherein the hydrophobicity degree HD is obtained by an expression $$HD = \frac{\text{(Methanol weight after evaluation)}}{\text{(Methanol weight after evaluation)} + \text{(Weight of added pure water)}} \times 100$$

where the weight of added pure water represents weight of the pure water added to the brilliant pigment particles from a start of addition of the pure water to a stoppage of the addition, and the methanol weight after evaluation represents methanol weight at a point when the brilliant pigment particles as solid matter precipitates at a surface of solution including the pure water and the methanol.

12. A developing agent container comprising:

the toner according to claim 8; and a container part that stores the toner.

13. An image forming unit comprising:

the toner according to claim 8; and a development device that stores the toner and supplies the toner to an image bearing body on which an electrostatic latent image is formed.

14. An image forming apparatus comprising:

the image forming unit according to claim 13;

an image transfer section that transfers a toner image formed on the image bearing body in the image forming unit onto a record medium; and a fixation section that fixes the transferred toner image.

* * * * *